US006705941B1

(12) United States Patent
van den Bergh

(10) Patent No.: US 6,705,941 B1
(45) **Date of Patent: *Mar. 16, 2004**

(54) FORM FOR NON-IMPACT PRINTERS

(75) Inventor: Theo van den Bergh, Herenthout (BE)

(73) Assignee: Monti N.V. -S.A., Lier (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 524 days.

(21) Appl. No.: 08/767,249

(22) Filed: Dec. 13, 1996

(30) Foreign Application Priority Data

Mar. 26, 1996 (BE) ..... 09600268

(51) Int. Cl.[7] ..... B41L 1/26

(52) U.S. Cl. ..... 462/26; 229/68.1; 281/2; 283/61; 283/105

(58) Field of Search ..... 281/2, 5; 462/26, 462/39, 22, 66, 68, 25; 503/200, 206; 283/61, 62, 105, 116; 229/68.1, 69, 71, 313

(56) References Cited

U.S. PATENT DOCUMENTS

| | | | | | |
|---|---|---|---|---|---|
| 645,900 | A | * | 3/1900 | Frease | 462/25 |
| 804,720 | A | * | 11/1905 | Halle | 462/25 |
| 839,927 | A | * | 1/1907 | Hawkins | 462/66 |
| 1,301,834 | A | * | 4/1919 | Gilman | 462/66 |
| 2,304,219 | A | * | 12/1942 | Wagner | 462/66 |
| 2,320,687 | A | * | 6/1943 | Wehmann, Jr. | 462/66 |
| 2,327,215 | A | * | 8/1943 | Potter | 462/66 |
| 2,360,142 | A | | 10/1944 | Kerr | |
| 2,535,798 | A | | 12/1950 | Johnston | |
| 3,163,447 | A | * | 12/1964 | Seekins | 462/66 |
| 3,419,286 | A | * | 12/1968 | Noonan et al. | 503/206 |
| RE30,958 | E | * | 6/1982 | White | 40/310 |
| 4,460,676 | A | * | 7/1984 | Fabel | 281/2 |
| 4,889,278 | A | * | 12/1989 | Steidinger | 229/92.1 |
| 4,996,184 | A | * | 2/1991 | Bevan et al. | 503/206 |
| 4,997,205 | A | * | 3/1991 | Hansch | 281/5 |
| 5,154,668 | A | * | 10/1992 | Schubert | 462/25 |
| 5,238,178 | A | * | 8/1993 | Hutchinson et al. | 229/92.1 |
| 5,393,265 | A | * | 2/1995 | Linden et al. | 462/25 X |
| 5,395,288 | A | * | 3/1995 | Linden et al. | 281/5 |
| 5,413,383 | A | * | 5/1995 | Laurash et al. | 462/22 |
| 5,435,600 | A | * | 7/1995 | Griffiths et al. | 503/206 |
| 5,545,459 | A | * | 8/1996 | Chang | 428/121 |
| 5,899,504 | A | * | 5/1999 | Fabel | 283/109 |
| 6,173,888 | B1 | * | 1/2001 | Fabel | 229/71 |
| 6,217,079 | B1 | * | 4/2001 | Fabel et al. | 283/110 |

* cited by examiner

*Primary Examiner*—Monica S. Carter
(74) *Attorney, Agent, or Firm*—Jones, Tullar & Cooper, P.C.

(57) ABSTRACT

The invention concerns a form for non impact printers, characterized in that it consists of four sections including an upper section and a lower section, and in that each section is separated from the next section by parallel fold lines or perforations. The upper section has the same surface area as the total surfaces of the two subsequent sections, over which the upper section is folded before printing, in such a manner that after printing the upper section can be folded further over the lower section and that an image can be transferred to the lower section by means of mechanical or chemical self-copying techniques by exerting a pressure on the upper section.

9 Claims, 2 Drawing Sheets

FORM FOR NON-IMPACT PRINTERS

FIELD OF THE INVENTION

The present invention relates to a form for non-impact printers.

SUMMARY OF THE INVENTION

An object of the present invention is to develop a provide a form for a non-impact printer, which can be used after printing as a traditional self-copying form, notwithstanding the fact that it is essentially intended for being printed by means of a so-called non-impact printer.

To achieve this object in accordance with the present invention, the form consists of four sections and in that each section is separated from the next section by parallel fold lines or perforations, with the upper section having the same surface area as the total surfaces of the two subsequent sections, over which the upper section is folded before printing, and such that after printing the upper section can be folded further over the lower section and that an image can be transferred to the lower section by means of mechanical or chemical self-copying techniques by exerting a air pressure on the upper section.

Other details and advantages of the present invention will become apparent from the following description of a form for non-impact printers according to the present invention. This description is only given by way of example and does not limit the present invention. The reference numerals relate to the figures annexed hereto.

DETAILED DESCRIPTION OF THE PREFERRED EMBODIMENT

By means of non-impact printers, it is not possible to print text on the subsequent pages of a multiple form or document. In practice, such a multiple form comprises several copies. It is therefore clear that non-impact printers can only print on the upper paper of a multiple document.

If one wishes nevertheless to print a so-called multiple form with non-impact printers, each of the subsequent copies have to be printed. In a further finishing step, these copies are joined back together for example by gluing or by another attachment process.

When composing a multiple self-copying form, the different pages have to be provided with the required chemical self-copying layer or layers, in case they are to be printed by non-impact printers, and these pages have to be inserted in the right order.

It is now possible with the forms according to the present invention to compose multiple forms. These are forms consisting of "sections", section 1 and 4 of which can be printed on by means of a non-impact printer. After being printed, these forms can be used as a self-copying form by applying the above described self-copying techniques.

Figure 1:
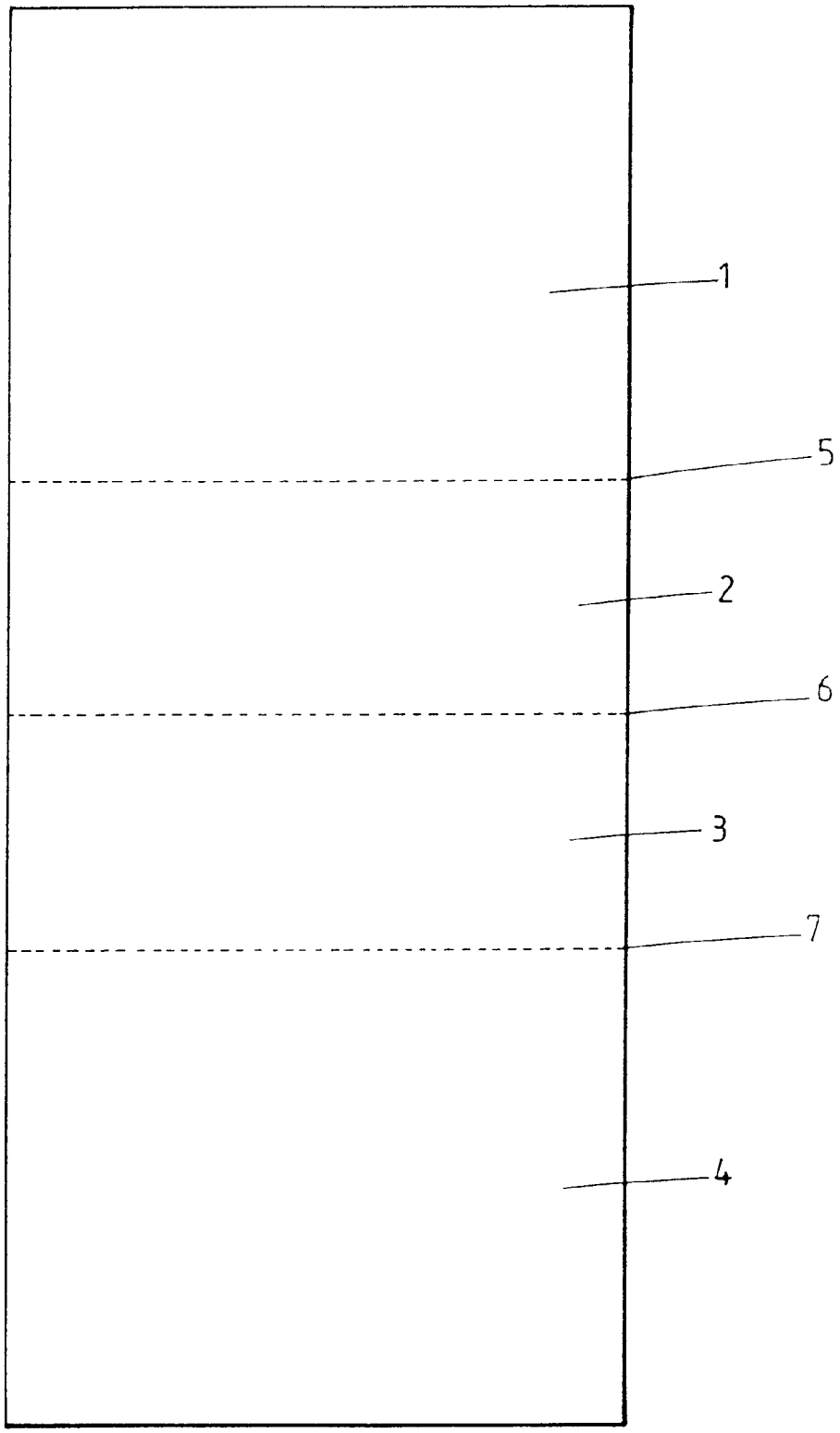
FIG. 1 shows a form according to the present invention in an open position.
Figure 2:
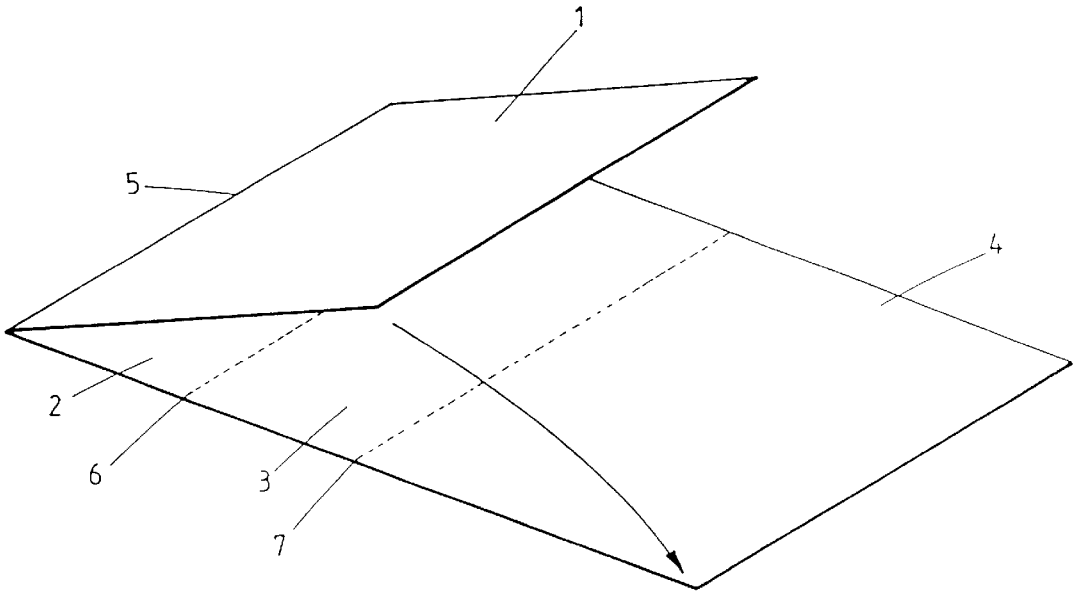
FIG. 2 shows the same form according to FIG. 1, wherein the first section is to be folded over sections 2 and 3. In this position, the fores are processed on a printer.
Figure 3:
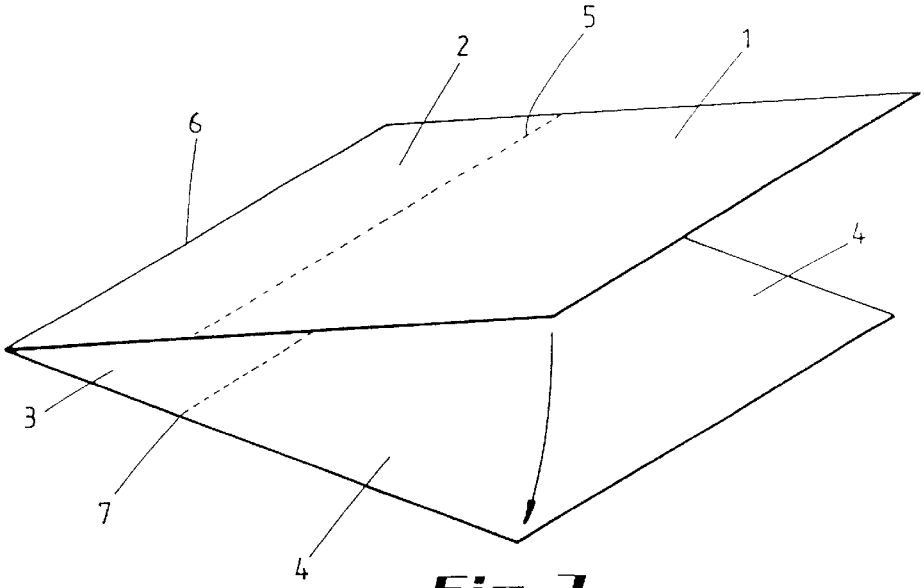
FIG. 3 shows the same form according to FIG. 1, wherein the first section is to be folded further over section 4.

According to one embodiment, shown in FIGS. 1, 2 and 3, the form consists of four sections, i.e. the sections 1, 2, 3 and 4. Section 1 is considered the upper section. This section 1 is followed by two sections 2 and 3 and a lower section 4.

Fold lines 5, 6 and 7 separate the different sections from one another (FIGS. 1 and 3).

By two folding operations along the fold lines 5 and 6, the form can be brought into the position according to FIG. 3 (starting from the position according to FIG. 1 via the position according to FIG. 2). In the folded position shown in FIG. 2, the form can be printed by means of a non-impact printer. The printed multiple form does not require a further finishing operation for being joined together, since it already forms a physical entity from the beginning, i.e. from being fed in the non-impact printer.

The obtained multiple form, which has been printed in a first phase by means of a non-impact printer, can then be used to be further completed manually or mechanically, since it is in fact a self-copying form.

The form is suited to be used as a multiple self-copying form which has already been printed in the first phase by means of the non-impact printer.

The fold lines 5, 6 and 7 can also be formed by perforations. Consequently, it is clear that the upper section 1 and the lower section 4 can be removed in one operation from the form.

The three most important self-copying techniques are possible:

In the first case, a mechanical coating is applied on the back of section 1. An example thereof are forms with warm carbon an the back (such as airline tickets). When section 1 overlaps sections 2 and 3 and a pressure is exerted onto section 1, an image will be formed on sections 2 and 3.

When section 1 is folded further over section 4 and a pressure is exerted onto section 1, an image Will then be formed on section 4.

In the second case, a chemical coating is applied to section 1 and another chemical coating to section 4 and possibly also to sections 2 and 3. An image can only be formed when a pressure is exerted on section 1, so that a chemical reaction takes place on sections 2 and 3 and an image is formed thereby, or when, after folding section 1 further over section 4, a pressure is exerted on section 1, so that a chemical reaction takes place on section 4 and an image is formed thereby.

In the third case, no coating is applied to section 1. The chemical coating is, however, applied to section 4 and possibly also to sections 2 and 3. This chemical coating gets another color (formation of an image) when a pressure is exerted thereon.

When this self-reacting coating is located on sections 2 and 3 and a pressure is exerted on section 1, an image will be formed on sections 2 and 3. When this self-reacting coating is located on section 4 and section 1 is folded further over section 4, an image can be formed on section 4 when a pressure is exerted on section 1.

The form according to the present invention thus combines the advantages of a non-impact printer with the possibilities of the usual self-copying techniques. These self-copying techniques include the impact printing technique having as drawbacks: noise nuisance and restricted possibilities with respect to layout and fonts.

Non-impact printers obviate these drawbacks entirely. Efficient laser or ink jet printers (non-impact) offer the possibility of printing the entire type page for minimum editions on usual paper by oneself.

Hence, the form according to the present invention offers the possibility of applying at any time, in a later phase a text, a drawing or a signature by means of the conventional self-copying techniques. A form according to the present invention has thus a particularly high "flexibility" or adaptability.

What is claimed is:

1. A form for non-impact printers, comprising: an upper section; a lower section; two subsequent sections located between the upper section and the lower section; and a coating located on the back of at least one of said upper section and said lower section, wherein:

each section is separated from the next section by a fold line formed as a perforation;

said upper section having a surface area equal to that of said two subsequent sections;

said upper section and the next one of said two subsequent sections have a surface equal to that of the other of said two subsequent sections and said lower section; and said upper section is located relative to said two subsequent sections so that said upper section is folded onto said two subsequent sections and is thus adapted for printing on said upper section in a non-impact printer.

2. The form as defined in claim 1, wherein said coating includes carbon, and said pressure is applied mechanically to said upper section to transfer an image to said two subsequent sections.

3. The form as defined in claim 1, wherein said coating includes carbon, and said pressure is applied chemically to said upper section to transfer an image to said two subsequent sections.

4. The form as defined in claim 1, wherein said coating comprises a self-reacting layer of material.

5. The form as defined in claim 1, wherein each of said two subsequent sections extends between and to its associated fold lines.

6. The form as defined in claim 1, wherein said coating is located so that an image is formed on said lower section when said upper section is folded over said lower section and a pressure is applied to said upper section.

7. The form as defined in claim 6, wherein said coating includes carbon, and said pressure is applied mechanically.

8. The form as defined in claim 6, wherein said coating includes carbon, and said pressure is applied chemically.

9. The form as defined in claim 6, wherein said coating comprises a self-reacting layer of material.

* * * * *